United States Patent [19]

Rodenberg et al.

[11] Patent Number: 5,040,029

[45] Date of Patent: Aug. 13, 1991

[54] MULTICOLOR IMAGE TRANSFER METHOD AND APPARATUS

[75] Inventors: Orville C. Rodenberg; James F. Paxon, both of Rochester; Richard C. Baughman, Geneseo; Rose M. Bothner, Rochester; William J. Hagen, Rochester, all of N.Y.

[73] Assignee: Eastman Kodak Company, Rochester, N.Y.

[21] Appl. No.: 430,037

[22] Filed: Nov. 1, 1989

[51] Int. Cl.[5] ..... G03G 15/16; G03G 15/01

[52] U.S. Cl. ..... 355/271; 355/312; 355/327

[58] Field of Search ..... 355/312, 271, 274, 327, 355/77

[56] References Cited

U.S. PATENT DOCUMENTS

| | | | |
|---|---|---|---|
| 3,702,482 | 11/1972 | Dolcimascolo . | |
| 3,729,311 | 4/1973 | Langdon . | |
| 3,781,105 | 12/1973 | Meagher . | |
| 3,795,441 | 3/1974 | Hoffman et al. . | |
| 3,832,055 | 8/1974 | Hamaker . | |
| 3,900,591 | 8/1975 | Kline . | |
| 4,014,606 | 3/1977 | Seanor et al. . | |
| 4,072,412 | 2/1978 | Suda et al. | 355/317 X |
| 4,190,348 | 2/1980 | Friday . | |
| 4,443,095 | 4/1984 | Tsushima et al. . | |
| 4,674,860 | 6/1987 | Tokunaga et al. . | |
| 4,676,627 | 6/1987 | Ohno | 355/326 X |
| 4,712,906 | 12/1987 | Bothner et al. . | |
| 4,740,813 | 4/1988 | Roy . | |

FOREIGN PATENT DOCUMENTS

| | | | |
|---|---|---|---|
| 0199370 | 11/1983 | Japan | 355/271 |
| 0077467 | 5/1984 | Japan | 355/271 |

*Primary Examiner*—R. L. Moses

*Attorney, Agent, or Firm*—Leonard W. Treash, Jr.

[57] ABSTRACT

Color toner images are transferred in registry to a receiving sheet held on a transfer drum. To facilitate releasing the sheet with the last image the drum surface is roughened, providing at least 0.002 inches between peaks and valleys. To offset difficulties created by such roughening in initial securing of the sheet to the drum, a transfer field is not applied as the leading edge of the sheet leaves the nip. The transfer field is applied after a short portion of the sheet, for example, 0.25 inches has left the nip.

12 Claims, 4 Drawing Sheets

MULTICOLOR IMAGE TRANSFER METHOD AND APPARATUS

TECHNICAL FIELD

This invention relates to the transfer of color images to a receiving sheet carried on a transfer drum in registration to form a multicolor image.

BACKGROUND ART

Electrophotographic color reproductions are conventionally made by forming monocolor toner images in different colors on an image member and transferring those images in registration to a single receiving sheet. The receiving sheet is held by a transfer drum, usually with gripping fingers, which is rotated to bring the receiving sheet repetitively into transfer relation in a nip with the image_member to overlay the toner images. Transfer is accomplished by an electric field in the nip having a direction urging the toner to move to the surface of the receiving sheet.

The field in the nip attracts the toner to the paper. At the same time, the field causes the paper to be attracted to the image member, which contributes to forces tending to cause the paper to follow the imaging member rather than the transfer drum.

Once the paper has been intimately held by the transfer drum, the paper can become electrostatically attracted to the drum and be difficult to remove. These competing forces vary with temperature and humidity. Thus, the industry has found great difficulty in controlling the paper in color transfer apparatus of this type, especially apparatus designed to operate in varying conditions over long runs with no paper jams. The industry approaches this difficulty by feeding the paper into contact with the drum well prior to the nip and gripping the paper with small fingers forming part of the drum to hold the paper securely. The fingers hold the paper until all transfers have been made and the paper has left the nip for the last time. At that point the fingers release the paper and paper separating skives separate the paper from the transfer drum. Although this approach has the advantages of reasonable certainty in holding the paper and releasing the paper, the gripping fingers on the transfer drum add complexity and the skives have a tendency to wear the drum.

Some color systems do not lend themselves to the use of gripping fingers at all. For example, U.S.Pat. No. 4,712,906, Bothner et al, issued Dec. 15, 1987, shows an electrophotographic color printer which forms consecutive images in different colors that are transferred in registry to a receiving sheet. The receiving sheet is wrapped around a transfer drum and recirculated on the surface of the drum into transfer relation with the consecutive images to create a multicolor image on the sheet. To improve efficiency, large sheets, for example "ledger" size sheets are placed on the drum with the small dimension parallel to the axis of the drum and wrapped substantially around the transfer drum. Small sheets, for example, "letter" size sheets are placed with their long dimension parallel to the axis of the drum. Since the short dimension of letter size sheets is approximately half the long dimension of ledger size sheets, two letter size sheets are placed on the drum at approximately the same space as the single ledger size sheet. The Bothner invention is difficult to utilize with gripping fingers because the leading edge of the second letter size sheet is positioned at approximately the middle of a ledger size sheet. For some applications, retractable fingers may be made to work, but for many applications they would leave substantial image artifacts in a ledger size sheet. Bothner therefore suggests the use of vacuum holes which are positioned at the leading edge of each of the smaller sheets and may or may not both be activated for the ledger size sheet.

The Bothner structure as described works well for most environments. However, in some temperature and humidity conditions found in some locations difficulty is encountered both with initial pickup by the transfer drum of the transfer sheet and release of the transfer sheet from the transfer drum as the last image is being transferred.

U.S. Pat. No. 4,674,860 to Tokunaga et al issued June 23, 1987shows a transfer drum to which a receiving sheet is tacked electrostatically by spraying electrostatic charge on either the sheet or the drum or both. The bias on the transfer drum is switched between positive and negative to initially attract the sheet which has been charged and later to attract the toner to the sheet.

U.S Pat. No. 4,740,813 to Roy issued April 26, 1988 shows a transfer drum using vacuum holes in which the vacuum portion of the drum is not biased when in the nip to aid in the location of the leading edge and trailing edge of the receiving sheet.

U.S. Pat. No. 4,014,606 to Seanor et al issued March 29, 1977 suggests that a tendency of a receiving sheet receiving a single image to wrap around a transfer roller to which it is not intended to be attached will be lessened if the roller has a texturized front surface. This patent suggests grinding the surface of the roller to a roughness in the range of between 2 and 8 mils between peaks and valleys. In addition to grinding the roller the patent suggests the texturizing surface can be formed by covering the roller surface with nylon, spraying particulate material onto a tacky roller surface or embossing the roller surface. The patent suggests that ionization of the air occurs between the transfer roller and the image member while the peaks of the surface hold the paper away from the transfer roller and allow the receiving sheet to continue to be attached to the image member. See also U.S. Pat. No. 3,795,441 Hoffman et al issued March 5, 1974.

U.S. Pat. No. 3,900,591 to Kline issued Aug. 19, 1975 shows a transfer drum having a vacuum fo holding a sheet to accept a single color image in which separation of the sheet is accomplished by reversing the vacuum and essentially blowing the receiving sheet away from the drum. See also U.S. Pat. No. 3,832,055 to Hamaker issued Aug. 27,1974 for other single color transfer drums with vacuum holding devices.

U.S. Pat. No. 4,190,348 to Friday issued Feb. 26, 1980; U.S. Pat. No. 4,443,095 Tsushima et al issued April 17, 1984 are representative of a large number of patents which show the use of varying electrostatic charges to aide in the release of the receiving sheet after transfer.

U.S. Pat. No. 3,729,311 to Langdon issued Apr. 24, 1973 shows a multicolor imaging method in which the transfer bias is changed for each consecutive color.

DISCLOSURE OF INVENTION

It is the object of the invention to provide a method and apparatus of forming a multicolor toner image on a receiving sheet in which method and apparatus the receiving sheet is held to a transfer drum by a vacuum and, which receiving sheet is attached reliably to the drum for receiving transfer of toner images and is separated reliably from the drum at the end of such transfer.

This and other objects are accomplished by a method and apparatus in which a receiving sheet is moved into a nip formed by a transfer drum and an image member. The transfer drum has a surface that deviates from perfectly smooth by at least 0.002 inches measured between peaks and valleys on said surface. A transfer field normally used to urge transfer of the toner images to the receiving sheet is not applied while the leading edge of the transfer sheet leaves the nip as the transfer sheet receives the first image. A vacuum applied through holes in the drum attracts the leading edge and attaches the sheet to the drum. When the last image to be transferred enters the nip, the vacuum is cut off and the transfer field maintained. The sheet follows the image member encouraged by the transfer field, facilitated by the roughened surface of the drum and no longer prevented by the vacuum.

With this method and aparatus both gripping fingers and skives have been eliminated while still maintaining very high reliability in attaching the receiving sheet to the drum and separating the receiving sheet from the drum through an extended range of temperature and humidity. The sheet can be attached when desired and released when desired. That process can be repeated with a highly desirable vacuum hole attaching system without skives through runs of thousands of images in a variety of ambient conditions.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
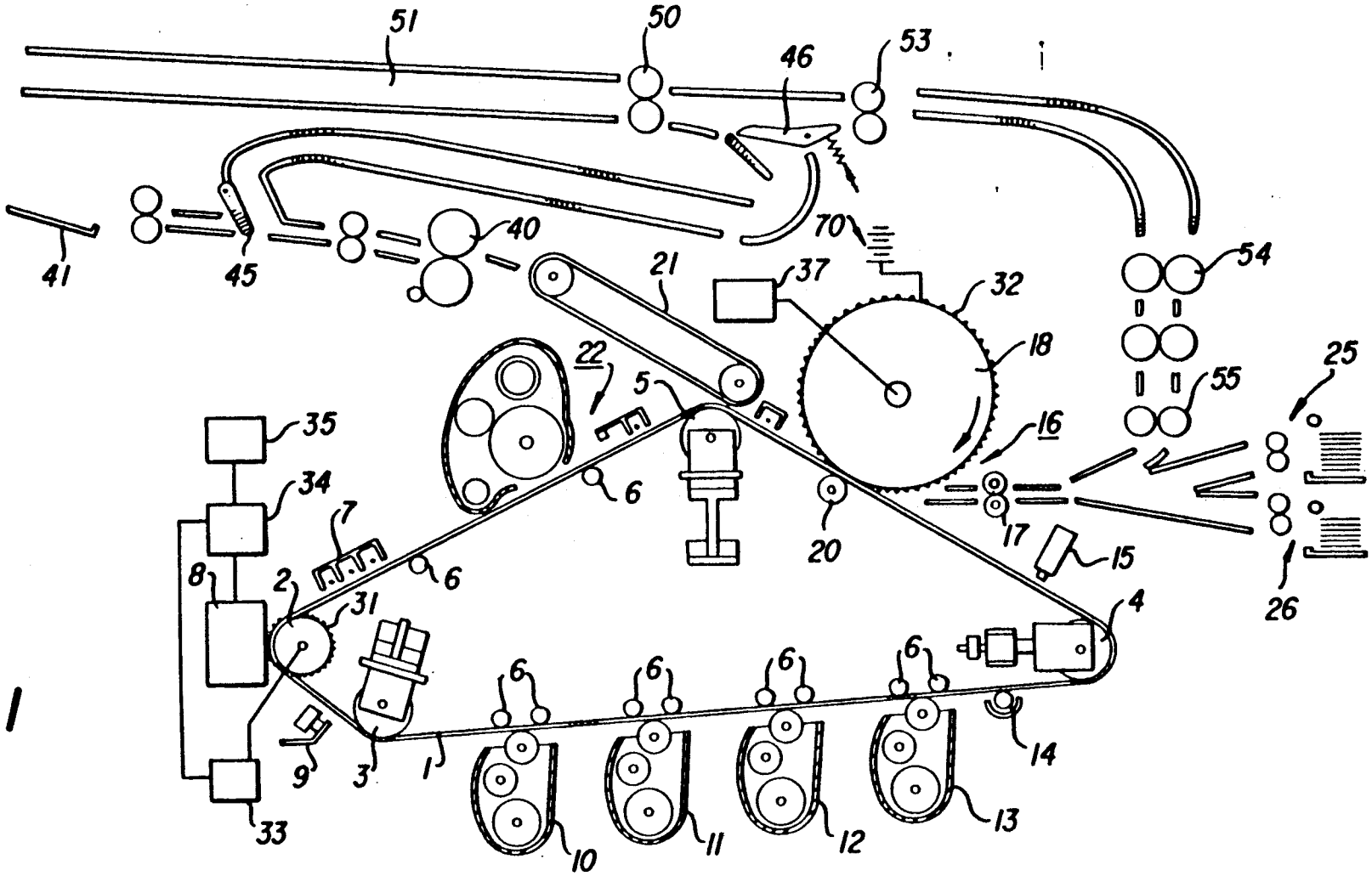
FIG. 1 is a schematic side view of a printer constructed according to the invention, with many parts eliminated for clarity of illustration.

According to FIG. 1 a film core portion of a copier or printer includes an image member, for example, an endless electrophotoconductive web 1 entrained about a series of primary rollers 2, 3, 4 and 5, and other supporting structure, for example film skis 6.

Web is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The web then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the electrostatic image has been toned the web passes under a densitometer 15 which measures the density of the toner image, also for use in controlling the process. The toner image then proceeds to a transfer station 16 where the image is transferred to a tranfer surface of a receiving sheet carried by a transfer drum 18.

The transfer drum 18 includes vacuum holes 19 (FIGS. 2–3) for securing the receiving sheet thereto for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 70, compared to the conductive layer of the web 1 or to a backing roller 20 for the web. This process has been well-known in the art for many years, see for example, U.S. Pat. No. 3,702,482 to Dolcimascolo et al issued Nov. 7, 1972. Although either the web 1 or the drum 18 could be at ground, conventionally the conductive backing is at ground and the drum at a relatively high voltage. For example, if the toner to be transferred is positively charged, the drum can be biased to −3000V by electrical source 70.

As thoroughly discussed in U.S. Pat. No. 4,712,906, cited above, when the apparatus is operating in a multi-image mode, for example, a multicolor mode, consecutive images or pairs of images are toned with different colored toners using the different toning stations 10–13. These consecutive images are transferred in registry to the receiving sheet as it repeatedly is brought into transfer relation with the web 1 by the drum 18. After the transfer operation is complete, the receiving sheet is allowed to follow the web. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

Figure 2:
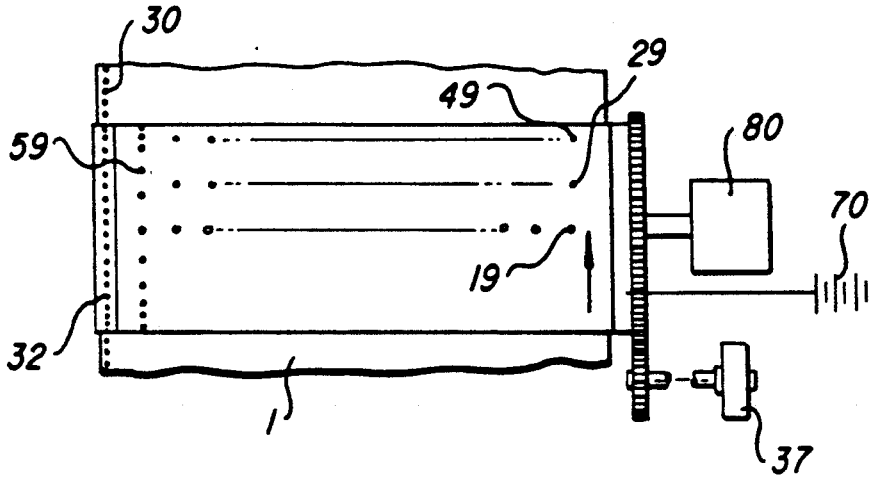
FIG. 2 is a top view of a portion of a transfer apparatus in which the invention is useable.

The transfer drum 18 is driven by a motor 37. The drum 18 in turn drives the web 1 through a sprocket 32 which engages perforations 30 (FIG. 2). The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51 until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply 25, which first supply may include, for example, letter size sheets being fed with their short dimension parallel with the direction of feed. Second, it may receive sheets from a second supply 26, which, for example, may include ledger size sheets with their long dimension parallel to the direction of feed. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets. For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

Figure 3:
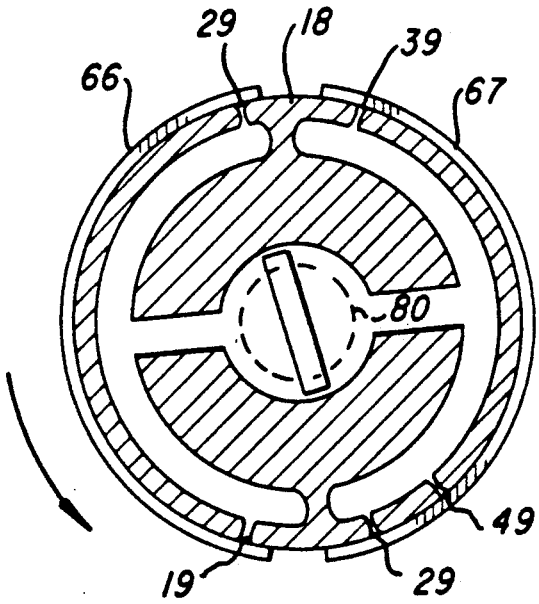
FIG. 3 is a partially schematic cross-section of a transfer drum shown in FIG. 2.

The vacuum system for transfer drum 18 is best seen in FIGS. 2 and 3. According to FIG. 2, vacuum holes 19 are positioned across the length of drum 18 to grip the leading edge of a receiving sheet. Vacuum is applied to the holes from a source of vacuum shown schematically at 80 through suitable conduits and valves, some of which are not shown. U.S. Pat. No. 4,712,906 is incorporated by reference herein and shows more details of a suitable mechanism for applying and releasing the vacuum at the appropriate times for the holes gripping the leading edges of receiving sheets.

The drum 18 has an aluminum core and a polyurethane outer layer. Preferably, the polyurethane is of an intermediate conductivity, for example, it may have a resistivity of $5\times10^9$ohms-cm. Transfer rolls having an outer layer or layers of intermediate conductivity are well known and have certain advantages over drums having greater conductivity. The outer layer in the FIGS. is shown as a single layer, but can be more than one. See, for example, U.S. Pat. No. 3,781,105, Meagher, issued Dec. 25, 1973 for a discussion of advantages of intermediate conductivity transfer drums and illustrating use of a two outer layer drum. The polyurethane layer is sufficiently conductive that it helps establish the electrical field urging transfer.

As seen in FIG. 3, vacuum holes 19 grip the leading edge of a first letter sized receiving sheet 66 which encompasses slightly less than half the circumference of the drum 18. The leading edge of a second letter size sheet 67 is gripped by another row of vacuum holes 39. For many grades of paper, vacuum holes for the leading edge are adequate. However, for best holding of a wide grade of materials, including transparency stock, vacuum holes 29 located along the trailing edge of the sheets assist in the holding process, preventing creep of the receiving sheet on the drum surface and thereby preventing misregistration of images. Additionally, a set of vacuum holes 59 (FIG. 2) can be positioned along one or both lateral edges of the image areas to provide additional holding force.

If a ledger sized receiving sheet is to be used, the leading edge is still attached using vacuum holes 19 but, the sheet will stretch across one row of holes 29 and the row of holes 39 ending up short of the second row of holes 29. To secure the trailing edge of ledger sheets an additional row of holes 49 is provided. If the trailing edge of other sizes of sheets (for example, legal size) is to be secured, additional rows of holes for the trailing edges will be necessary.

As described in the Bothner et al patent, as the last image enters the nip, the vacuum is removed to allow the receiving sheet to follow the image member.

A problem is encountered at some conditions of temperature and humidity at this point. An occasional receiving sheet has become so intimately attached to the drum it does not follow the web and stays with the drum. This ultimately jams the apparatus. Although the jam may be readily clearable by the operator, modern printers and copiers are not content with even one such jam in a thousand sheets.

To correct this problem, the polyurethane surface of transfer drum 18 has been made rough by grinding such that peaks and valleys on the surface are separated by at least 0.002 inches. This textured surface acts as a spacer, providing small air gaps between the surface of the drum and the paper.

The air allow some ionization of air to take place in the transfer nip itself between the paper and the drum. This appears to improve the efficiency of transfer of the toner to the paper and significantly reduce the electrostatic attraction of the paper to the drum surface. In addition, it is believed that the ionization injects charge on the back side of the paper tending to tack the paper to the image member. In essence, it makes the paper less attracted to the drum and more easily released from it. With the roughened surface, runs in excess of 20,000 sheets have been accomplished in a variety of temperatures and humidities without a failure to release when the vacuum is removed.

With peaks and valleys in excess of 0.005, the sheet still reliably releases when the vacuum is removed. However, the texture can show up on the image. Thus, for applications where such texture is undesirable, a surface with 0.002 to 0.005 inches separation between peaks and valleys is desirable.

The roughened surface can be created by means other than grinding. For example, a nylon stocking secured around the drum eliminated release failures. (However, if the stocking was too coarse, the texture showed in the image.) Other such cloth materials could be used. Small roughening particles can be molded in or coated to the polyurethane surface.

Unfortunately, this roughened surface makes somewhat more difficult initially attaching the leading edge of the receiving sheets to drum 18. That is, at some temperatures and humidities, the sheet follows the image member despite the presence of the vacuum. FIGS. 4–8 describe the solution to the problem created by the texturizing of the surface.

Figure 4:
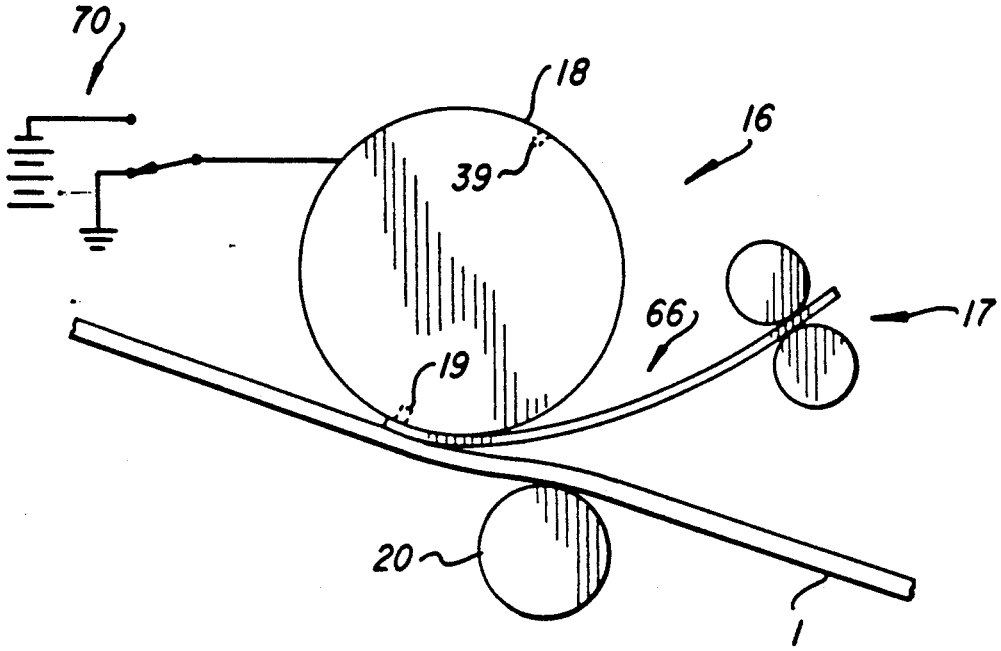
FIGS. 4 and 5 are cross-sections of the transfer station and surrounding environment illustrating the adjustment of the transfer bias according to the invention.

According to FIG. 4 a first receiving sheet 66, a letter size sheet with its short dimension in the in-track direction, is fed by roller 17 into the nip between transfer drum 18 and image member 1 in timed relation with the arrival in the nip of vacuum holes 19. Preferably, the receiving sheet 66 engages the drum 18 slightly before the nip, at which point the vacuum is applied through holes 19 to secure the leading edge of sheet 66 to the drum.

According to FIG. 4, while the leading edge of receiving sheet 66 is in the nip the transfer drum is grounded (through a switch shown in FIGS. 4–8 as part of power source 70) and vacuum applied through holes 19. Under these conditions the leading edge is attached to the drum and separates from the image member 1 as the sheet 66 begins to exit the nip.

Figure 5:
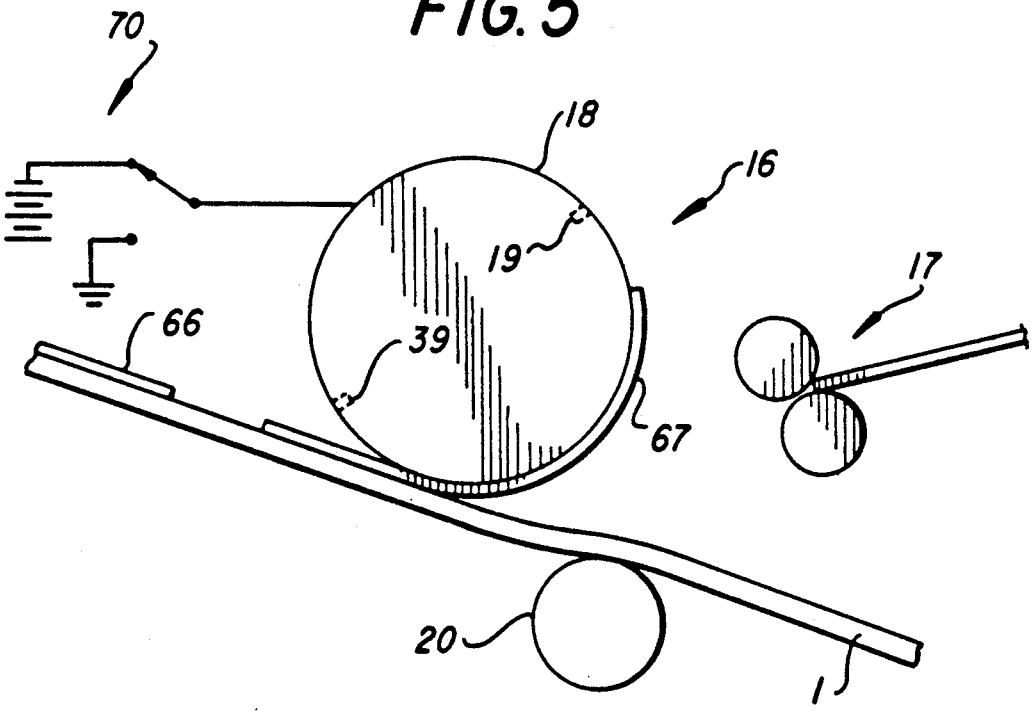

Just after the receiving sheet 66 exists the nip and the leading edge separates from image bearing member 1 the power source 70 which applies the transfer bias to drum 18 is switched from its position shown in FIG. 4 where it is grounded to its position shown in FIG. 5 where it applies a suitable transfer bias to drum 18. The transfer bias is not applied until the leading edge has released from image bearing member 1 to prevent that bias from causing the receiving sheet 66 to be so attracted to image bearing member 1 that it will not release from it and will follow image bearing member 1 rather than be tacked to the transfer drum. However, after the leading edge has separated from the image member 1, the vacuum through holes 19 is sufficient to maintain the leading edge of sheet 66 securely on drum 18 as drum 18 rotates. The second receiving sheet 67, also letter size with its short dimension in the in-track direction is similarly fed into contact with drum 18 as vacuum holes 39 approach the nip. Again, as the leading edge of receiving sheet 67 is just exiting the nip the voltage source 70 is switched to the position shown in FIG. 4 to remove the transfer field from the nip so that the leading edge of receiving sheet 67 is not encouraged to follow image bearing member 1.

With both sheets 66 and 67 attached to drum 18 the drum rotates through several revolutions as a plurality of different colored images are transferred to the sheets. As the last image to be transferred to first receiving sheet 66 approaches the nip, the vacuum to holes 19 is switched off while leaving the transfer voltage from source 70 on. The transfer voltage assists in forcing the leading edge of receiving sheet 66 to follow image bearing member 1 and separate from transfer drum 18. Similarly, when the second receiving sheet 67 reaches the nip the vacuum applied through holes 39 is switched off and receiving sheet similarly follows image bearing member 1 as shown in FIG. 5.

Although a single bias is shown on voltage source 70, it is well recognized in the art that different biases may be appropriate for transfers of different colored images because of variations in the toner or because of previous images already transferred to the receiving sheets. It is also understood that ground is an arbitrary voltage. Thus, the ground position for voltage source 70 could be replaced by a lower voltage of the same polarity as the transfer voltage or a voltage of opposite polarity.

If the transfer drum 18 were smooth, it would be easirer to secure receiving sheets 66 and 67 to the smooth surface. For most humidities and temperatures, no bias adjustment would be necessary to secure a sheet to a smooth transfer surface. However, it is difficult to release the receiving sheet from a smooth transfer surface in many humidity-temperature conditions. As described above, the drum surface is texturized or roughened to make easier the release of the transfer sheets in the FIG. 5 situation. Because of the textured surface, the bias is switched off as shown in FIG. 4 to initially secure the transfer sheets to the roughened surface of transfer drum 18.

Figure 6:
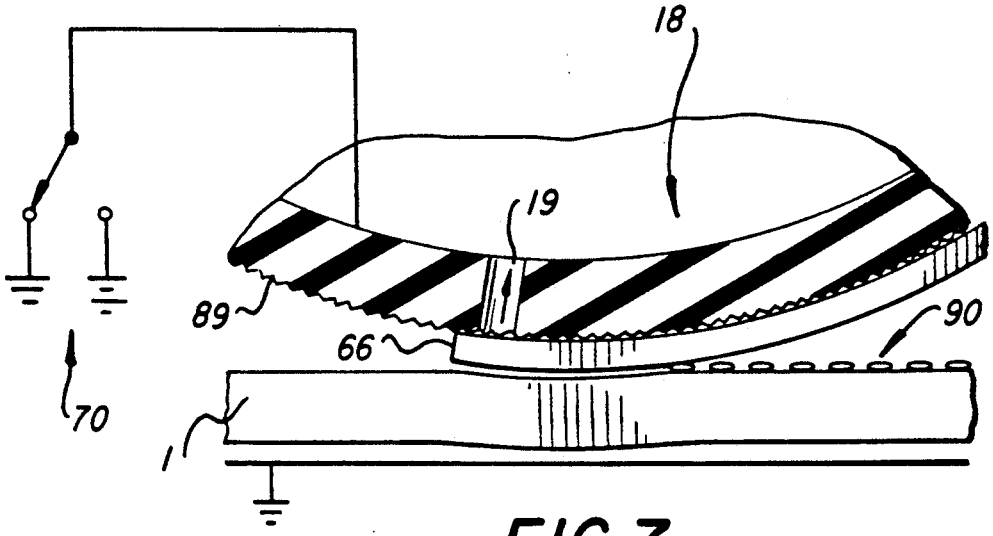
FIGS. 6–8 are partially schematic sections, with some dimensions exaggerated, of the transfer nip illustrating the forces on a receiving sheet in the initial attaching, transfer, and release conditions of the sheet, respectively.
Figure 7:
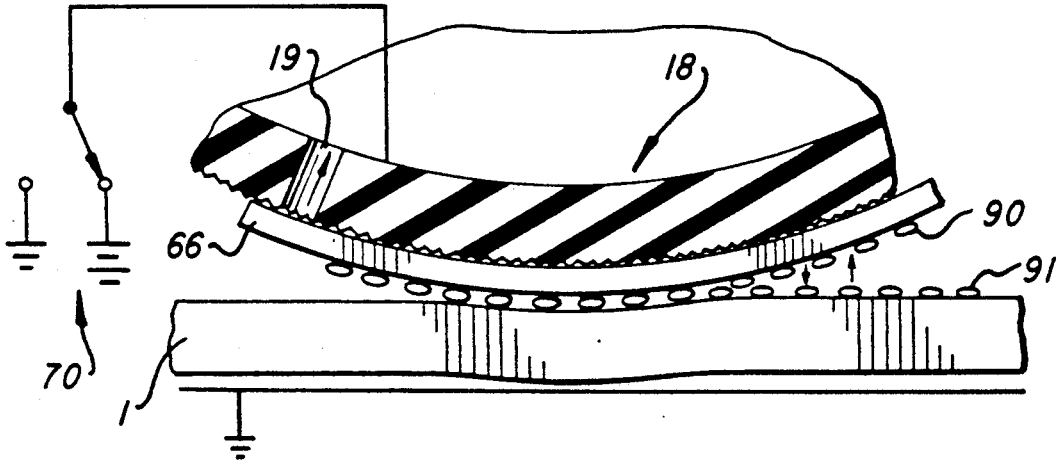
Figure 8:
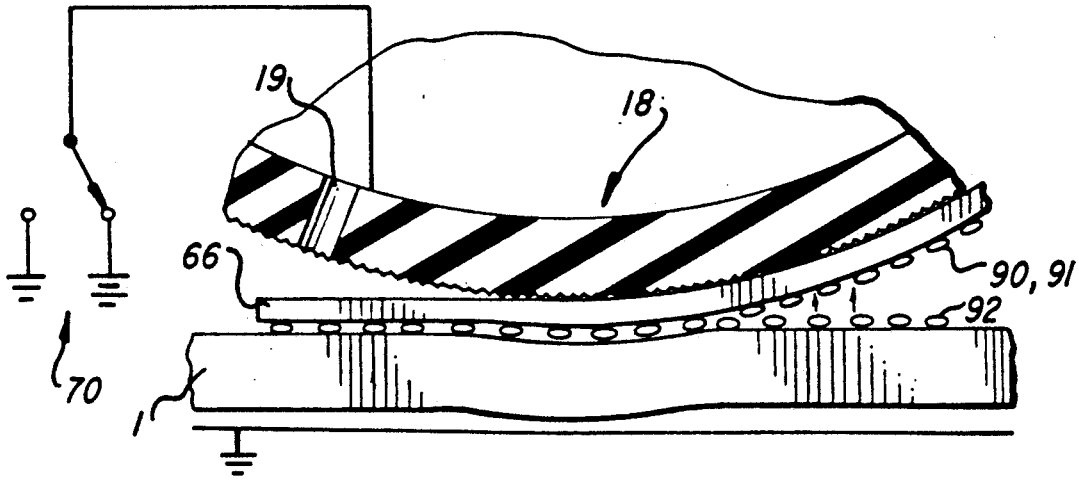

This is also illustrated in FIGS. 6–8. According to FIG. 6, the leading edge of receiving sheet 66 is just leaving the nip as the first toner image 90 enters the nip. The surface 89 of drum 18 has been roughened making adherence of the sheet 66 to it more difficult. However, no transfer voltage is applied from source 70. A vacuum shown by an arrow in hole 19 controls, and the sheet separates from image member 1 despite the roughened surface.

After the first, say 0.25 inches of the sheet (exaggerated in FIG. 6) has passed the center of the nip, the transfer voltage is applied.

Two or more images 90 and 91 are transferred in registration as shown in FIG. 7. Arrows in the prenip area are intended to show the electrical attraction created by the field between the paper and the toner. For best results over a variety of ambient conditions, the drum is grounded each time the leading edge of a receiving sheet exits the nip except the last one.

As shown in FIG. 8 as the last image 92 to be transferred to this sheet reaches the nip, the vacuum is cut off. The transfer field attracts the paper to the image member facilitated by the roughened surface of drum 18.

In the preferred application of this invention, the printhead 8 does not write on the beginning 0.25 inches of the image, a portion in the margin in most reproduction. However, since the last image is not affected by the grounding, the apparatus could be programmed to write one color, for example, black, to the edge of the sheet.

Thus, these two mechanisms, a roughened surface on transfer drum 18 and a removal of the transfer bias during initial securing of the leading edge of the receiving sheets, provide a transfer station with high reliability with a vacuum as the securing force. Skives or gripping fingers are not necessary. The reliability of the transfer mechanism described in the Bothner patent is maintained through a large variety of humidities and temperatures.

The invention has been described in detail with particular reference to a preferred embodiment thereof, but it will be understood that variations and modifications can be effected within the spirit and scope of the invention as described hereinabove and as defined in the appended claims.

We claim:

1. A method of forming a multicolor toner image on a receiving sheet comprising:

forming a plurality of toner images of different color on a moving image member, moving a receiving sheet into a nip formed by a transfer drum and the image member, said transfer drum having a surface that deviates from perfectly smooth by at least 0.002 inches measured between peaks and valleys on said surface, attracting the leading edge of the receiving sheet to the transfer drum by a vacuum applied through vacuum holes in said drum, only after said leading edge has been attracted to said drum by said vacuum, applying an electric field in said nip of a direction and strength to transfer said toner image, rotating the transfer drum to bring the receiving sheet repeatedly into transfer relation with the toner images to transfer the toner images in registration to the receiving sheet, and releasing the vacuum applied through said holes as said leading edge leaves the nip during the transfer of the last image while maintaining said transfer field, to cause said sheet to adhere to said image member and leave said transfer drum.

2. The method according to claim 1 wherein said transfer drum has a circumference large enough to accommodate two receiving sheets and has separate sets of vacuum holes for attracting each leading edge of said sheets, and said transfer field is not applied during the initial attraction of each of said leading edges.

3. The method according to claim 1 wherein said transfer drum has a polyurethane outer layer which has been roughened by grinding.

4. The method according to claim 1 wherein said transfer field is not applied as the leading edge of the transfer sheet leaves the nip prior to transfer of each image except the last one.

5. A method of transferring a plurality of toner images from an image member to a receiving sheet, said method comprising:

moving said receiving sheet into a nip formed by said image member and a transfer drum having an irregular surface, applying a vacuum through vacuum holes in said drum to attract the leading edge of said receiving sheet to the drum, after said leading edge has been attracted to said drum, applying an electric field in said nip of a direction and strength to transfer said toner images to the receiving sheet, rotating the transfer drum to bring the receiving sheet repeatedly through said nip to transfer the toner images to the receiving sheet, and releasing the vacuum through said holes as the leading edge goes through the nip during the transfer of the last image while maintaining said transfer field, to cause said receiving sheet to adhere to said image member and separate from said transfer drum.

6. The method according to claim 5 wherein said irregular surface is a cloth covering said drum.

7. The method according to claim 5 wherein said electric field is not applied to said nip as said leading edge leaves the nip before transfer of each image except the last one.

8. Apparatus for transferring a series of toner images in registration to a receiving sheet comprising:

a transfer drum having a surface that deviates from perfectly smooth by at least 0.002 inches measured between peaks and valleys on said surface and having at least one set of vacuum holes, an image bearing member forming a nip with said transfer drum, means for feeding a receiving sheet into said nip, means for applying a vacuum to said vacuum holes to secure said leading edge to said drum, and means for applying an electric field to said nip of a direction urging toner to transfer from said image bearing member to said receiving sheet, said means including means for reducing said field while the leading edge of a receiving sheet is being secured by said vacuum to the drum for the first time.

9. Apparatus according to claim 8 further including means for eliminating the vacuum on said vaccum holes while said leading edge of said receiving sheet passes through the nip in contact with the last image to be received to permit said sheet to adhere to the image bearing member and separate from the transfer drum.

10. Apparatus according to claim 8 wherein said means for reducing said field includes means for reducing said field as said leading edge leaves said nip before each image is transferred except the last image.

11. Apparatus according to claim 9 wherein said means for reducing said field includes means for reducing said field as said leading edge leaves said nip before each image is transferred except the last image.

12. A method of transferring a plurality of toner images from an image member to a receiving sheet, said method comprising:

moving said receiving sheet into a nip formed by said image member and a transfer drum having an irregular surface, attracting the leading edge of said receiving sheet to the drum, after said leading edge has been attracted to said drum, applying an electric field in said nip of a direction and strength to transfer said toner images to the receiving sheet, rotating the transfer drum to bring the receiving sheet repeatedly through said nip to transfer the toner images to the receiving sheet, and grounding said drum for a short time as said leading edge leaves the nip before transfer of each image except the last one.

* * * * *